United States Patent [19]

Washburn

[11] 4,397,245

[45] Aug. 9, 1983

[54] WORK PIECE HOLDER

[76] Inventor: Monard G. Washburn, Rte. 1, Box 163, Skiatook, Okla. 74070

[21] Appl. No.: 214,039

[22] Filed: Dec. 8, 1980

[51] Int. Cl.[3] ..... A47F 5/12

[52] U.S. Cl. ..... 108/7; 108/9

[58] Field of Search ..... 108/7, 6, 1, 9; 269/79, 269/71

[56] References Cited

U.S. PATENT DOCUMENTS

| | | | |
|---|---|---|---|
| 2,014,394 | 9/1935 | McNair | 108/9 |
| 2,314,144 | 3/1943 | Hicks | 108/82 X |
| 2,469,644 | 5/1949 | Harrison | 269/71 X |
| 2,471,003 | 5/1949 | Monahan | 108/9 |
| 2,639,541 | 5/1953 | Le Tang | 108/7 |
| 2,798,333 | 7/1957 | Griffith | 108/7 |
| 2,823,451 | 2/1958 | Suhan | 269/79 |
| 2,972,207 | 2/1961 | Hiers et al. | 108/9 |
| 3,047,286 | 7/1962 | Kinne | 269/79 |

*Primary Examiner*—Francis K. Zugel

*Attorney, Agent, or Firm*—Head, Johnson & Stevenson

[57] ABSTRACT

A tilting work table for supporting articles during work operations and having a base structure, a bed plate pivotally connected to the base structure, a plurality of hydraulic cylinders connected between the base structure and the bed plate to raise or tilt the bed plate from a horizontal position to a vertical position, a plurality of folding leg braces connected between the bed plate and the base structure and extendable into a position to form a "stiff-leg" arrangement for bracing the bed plate in substantially any tilted position, secondary cylinders connected between the leg braces and the base structure for urging the leg braces into the extended position and to "break" or initiate the folding of the leg braces when the bed plate is lowered from the vertical position to the horizontal position.

3 Claims, 3 Drawing Figures

WORK PIECE HOLDER

BACKGROUND OF THE INVENTION

1. Field of the Invention

The present invention relates to a tilting work table, and more particularly, to such a work table having folding leg braces to secure the table in a tilted position thereof.

2. Description of the Prior Art

During many work operations, such as painting, forming, drilling, or the like, of an article of manufacture, it is frequently advantageous to attach the work piece to a surface which can be rotated and/or tilted. This movement not only allows for the work piece to be positioned in a convenient manner for multiple work operations to be accomplished simultaneously, but also permits the use of less complicated and expensive work operation equipment.

Various work tables have been developed in the past to provide a movable working surface, with the most common type being work tables which raise or lower a work piece vertically by hydraulic or mechanical means and which also allows for the rotation of the work piece about a central vertical axis. These tables are commonly of the type used with vertical drill presses. Other tables used in more complicated assembly functions, or the like, raise and lower the work as well as tilt or pivot the working surface about a vertical and horizontal axis. These work tables have been used in the past for forming complex structures, such as ship propellers, and the like, but are far too complicated and expensive for smaller, simpler applications. A third type of table is presently available which does not raise the work piece, but tilts or pivots the work piece about a horizontal axis. This type of table has a work piece, such as a block of material, attached thereto, and may be tilted into a vertical position whereby a large horizontal drill press may be brought into contact with the work piece. These tilting tables are usually operated by gears or hydraulic cylinders which raise and lower the table in the vertical direction and provide the tilted position for the work piece.

In the event of loss of electrical, pneumatic or hydraulic power, complex safety systems must be installed on these tilting tables to prevent the table from rapidly falling back into a horizontal position. These safety systems normally include interlocking catch means, interlocking pins, safety valves and the like. These safety systems add greatly to the maintenance requirements and expense of the tables. Further, it is difficult to maintain these tables in a horizontal or tilted position with a maximum load carried thereby. The disadvantages of the presently available tables of this type will be apparent.

SUMMARY OF THE INVENTION

The present invention relates to a work table which overcomes the foregoing disadvantages by providing a tilting work supporting surface which may be supported in a tilted position in a manner substantially precluding accidental falling thereof in the event of a power failure, and by providing increased stability during use of the table. The work table generally comprises a base means which normally rests on the surface of the ground and a bed plate with the working surface means secured thereto and pivotally connected to the base means. A plurality of flanges extend downwardly from the bed plate and are journalled on a pivot shaft carried by the base means. The pivot shaft is offset with respect to the center of the bed plate, or in the proximity of one edge thereof so that when the bed plate is in a fully tilted position with respect to the horizontal, or substantially vertically disposed, one edge of the bed plate rests on a leveling pad provided on the base means whereby only a portion of the load is carried by the pivot shaft. Suitable hydraulic cylinders or the like are attached between the base means and the bed plate and are utilized to raise or tilt the bed plate about the longitudinal axis of the pivot shaft. A plurality of folding leg braces are suitably connected between the bed plate and the base means, and extend into a stiff or rigid supporting position when the bed plate is in a tilted position to rigidly hold the bed plate in the tilted position. The leg braces fold into a collapsed position when the bed plate is in a substantially horizontal position. Secondary cylinder means are secured between the leg braces and base means, and in the event of power failure or loss of hydraulic pressure at the main cylinders, the working surface will be safely maintained in the tilted position by the leg braces, since the contraction of the secondary cylinder means is required to begin or initiate the folding of the leg braces.

DETAILED DESCRIPTION OF THE PREFERRED EMBODIMENTS

Figure 1:
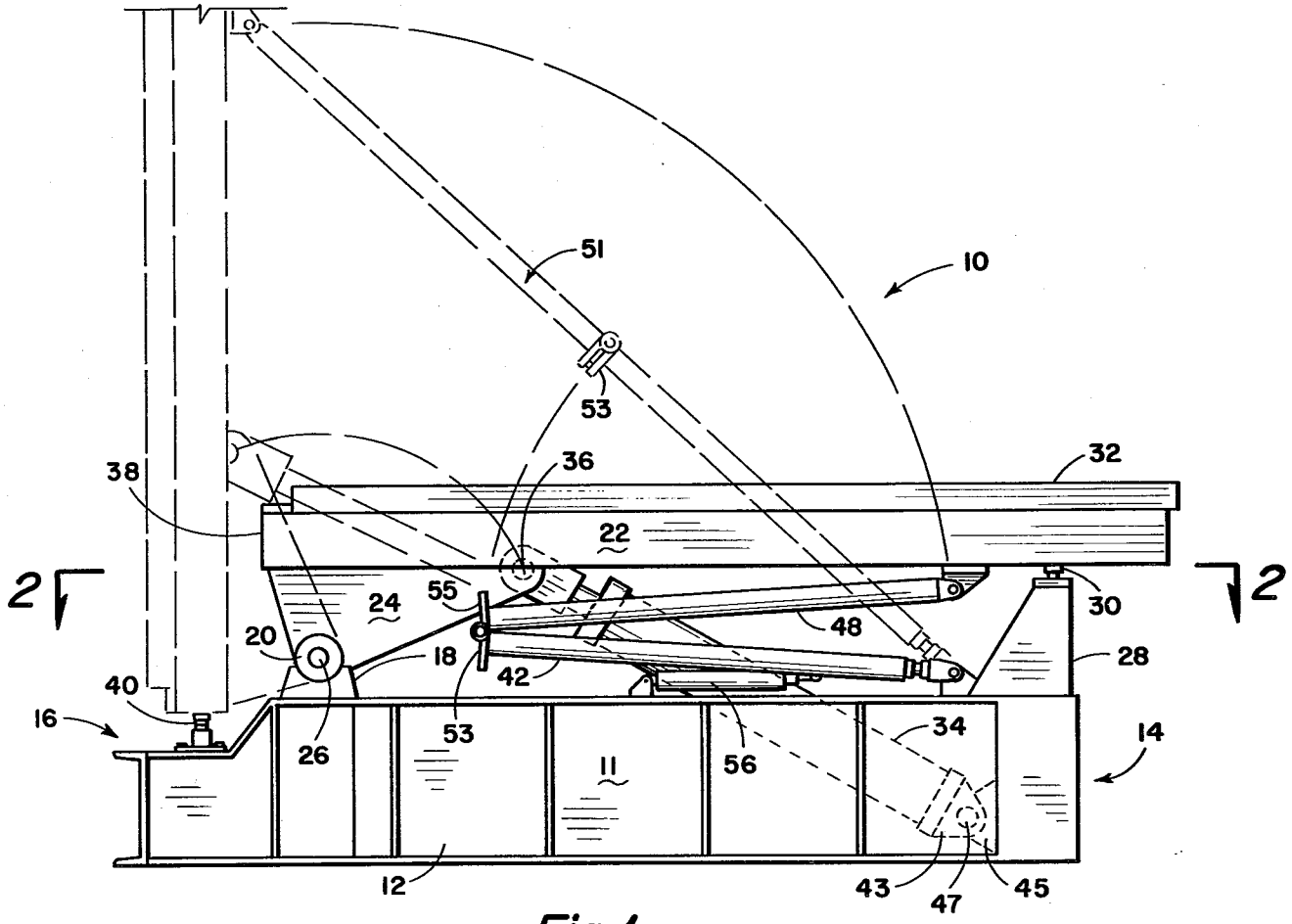
FIG. 1 is a side elevational view of a tilting work table embodying the invention, with a horizontal position of the working surface shown in solid lines and a full vertical position thereof shown in dashed lines.

Referring to the drawings in detail, reference character 10 generally indicates a tilting work table for supporting a work piece (not shown) during a work operation, such as the drilling of bores therein, or other manufacturing operations. As shown in FIG. 1, the work table 10 comprises a lower base structure 12 having a forward portion 14 and a recessed rear portion 16. The base structure 12 is preferably constructed from heavy gauge steel or other suitable material and is generally of an open box-like configuration, having oppositely disposed side members 11 and 13 spaced apart by at least two cross members 15 and 17. A first pair of spaced flanges 18 are secured to the side member 11 and extend upwardly therefrom to support a first bushing member 20 secured therebetween. A second pair of spaced flanges 19 are similarly secured to the side member 13 and extend upwardly therefrom to support a second bushing 21 secured therebetween. The bushings 20 and 21 are disposed in substantial axial alignment for receiving the opposite ends of a pivot shaft 26 therein.

An upper tilting frame 22 is pivotally connected to the base structure 12 in any suitable manner. As shown herein, a first pair of spaced flanges or gussets 24 and a second pair of spaced gussets 25 are preferably welded or otherwise secured to the lower surface or side of the frame 22. The pairs of gussets 24 and 25 support a suitable journal 27 and 29 therebetween, respectively. The journals 27 and 29 may rotate independently of the pivot shaft 26, or may be keyed or otherwise secured to the shaft 26 for rotation simultaneously therewith as the shaft rotates about its own longitudinal axis as will be hereinafter set forth in detail.

Upstanding support members 28 are secured on the base structure 12 adjacent the forward portion 14 thereof and are each provided with a suitable adjustable leveling pad 30 at the top portion thereof. As can be seen in solid lines in FIG. 1, the upper frame 22 is supported by the leveling pad 30 when in the horizontal or rest position. Attached to the top surface of the upper frame 22 is a planar bed plate 32 providing a working surface for the apparatus 10. The work piece (not shown) may be attached to the bed plate 32 in any desired position by any suitable well known means, such as clamps, chains, bolts, or the like (not shown).

Figure 3:
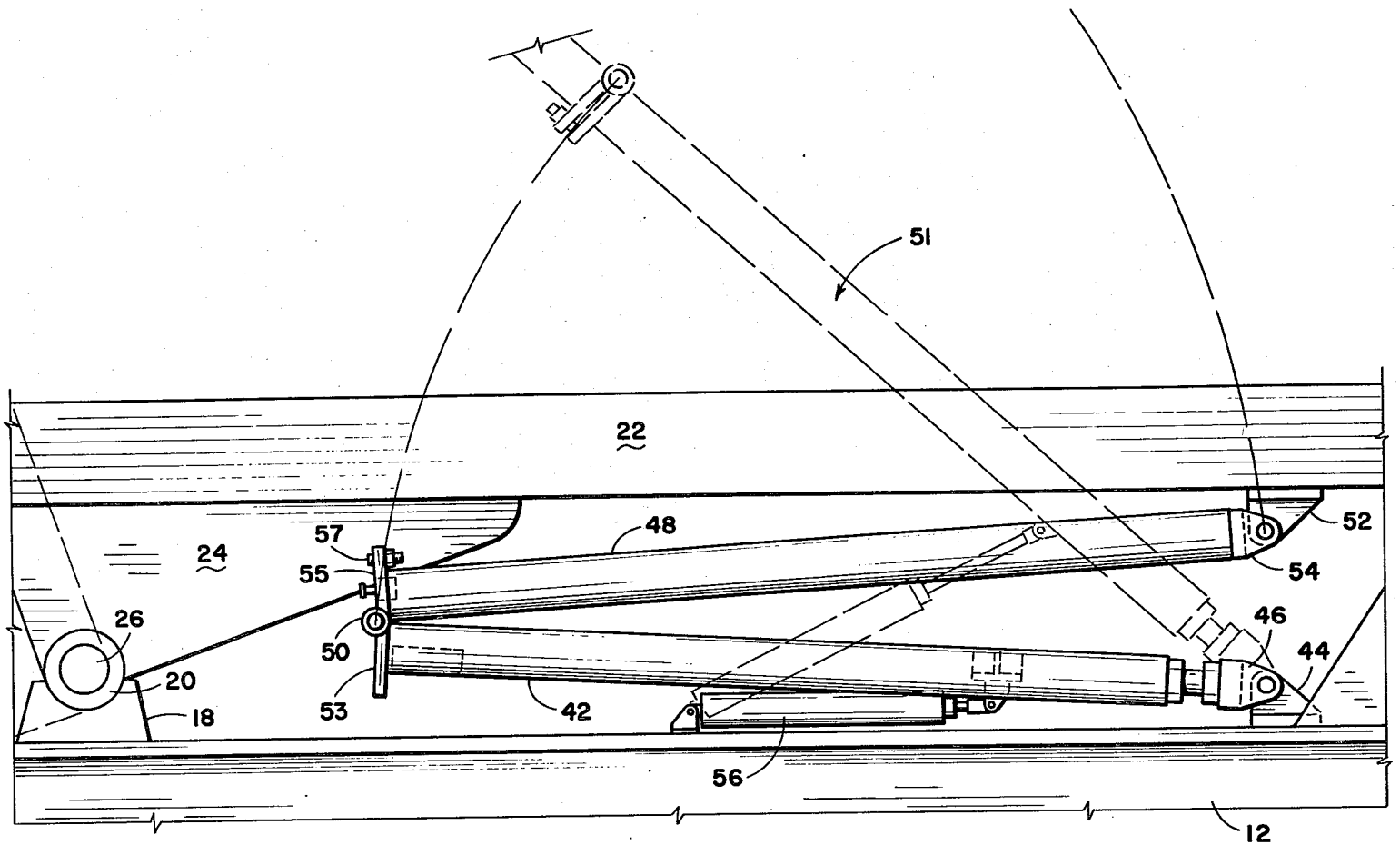
FIG. 3 is a detailed view of a folding leg brace as used in the invention, with the collapsed position thereof shown in solid lines and an extended position thereof shown in dashed lines.

At least two main hydraulic cylinders 34 and 35, or the like, are operably connected between the base structure 12 and the gussets 24 and 25, respectively. The piston rods 31 and 33 of the cylinders 34 and 35, respectively, are preferably secured to block members 37 and 39, respectively, which in turn are pivotally secured to pivot pins 36 and 41 anchored between the respective spaced flanges 24 and 25. The outer ends of the cylinders 34 and 35 are pivotally secured to the base structure 12 in any well known manner, such as by yoke means 43 pivotally secured to a clevis means 45 by pin means 47 as shown in FIG. 1. Hydraulic pressure fluid supply and control conduits (not shown) are connected to the hydraulic cylinders 34 and 35 in the usual manner and the pistons 31 and 33 are extended and contracted in the conventional manner. When the pistons 31 and 33 are contracted, the frame 22 and bed plate 32 are brought into the horizontal or rest position shown in solid lines in FIGS. 1 and 3. When the pistons 31 and 33 are extended, the frame 22 and bed plate 32 are pivoted about the axis of the shaft 26 toward a vertical or tilted position. Upon full extension of the pistons 31 and 33, an end portion 38 of the frame 22 comes to rest against a plurality of suitable adjustable leveling pads 40, which are attached to the recessed rear portion 16 of the base structure 12.

The longitudinal axis of the pivot shaft 26 is spaced from the end 38 of the upper frame 22 and is substantially parallel with respect thereto, whereby the upper frame 22 may be tilted into the vertical position for resting on the pads 40 in such a manner that a majority of the load is carried by the pads 40, thus adding to the stability of the table 10 while in the tilted position.

Figure 2:
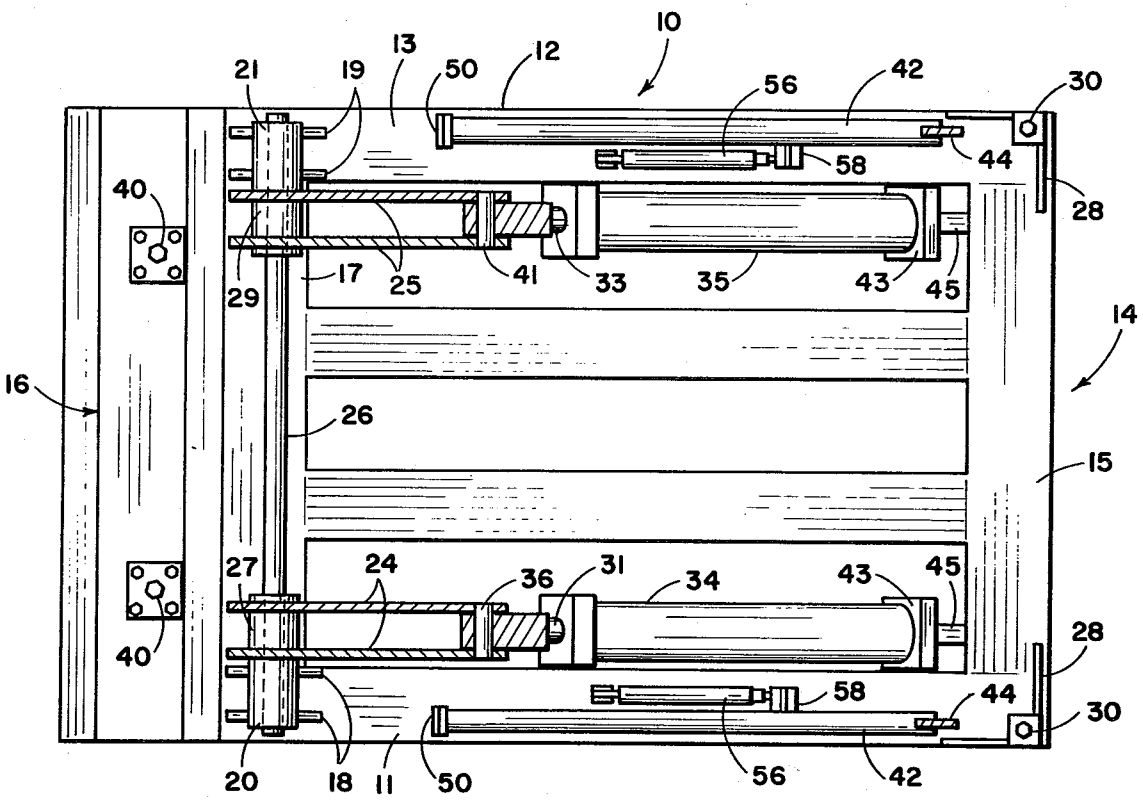
FIG. 2 is a view taken along line 2—2 of FIG. 1.

In order to stabilize the upper frame 22 while in the tilted or vertical position, the work table 10 is provided with folding leg braces 51, which are alternately collapsible and extensible. In the extended position, the legs 50 provide a "stiff-leg" bracing for the tilted position of the frame 22. The folding leg braces 51 are each comprised of a lower section 42 pivotally connected at one end thereof to the respective side members 11 and 13 by a clevis member 44 and yoke 46, as is well known. The clevis members 44 are preferably disposed inboard of the supports 30, as particularly shown in FIG. 2. The opposite end of each lower section 42 is provided with a stop plate 53, which is essentially one-half of a hinge means 50. An upper leg section 48 is provided for each leg brace 50 and is secured at one end to a stop plate 55, which is essentially the other half of the hings means 50. The plate 55 is preferably provided with a plurality of adjustable stop members 57 for controlling the engagement between the plates 53 and 55. Thus, the leg braces 51 may be extended for supporting substantially any desired tilted position for the bed plate 32. The opposite end of each upper section 48 is pivotally connected to the frame 22 by a clevis 52 and yoke 54.

A secondary cylinder means 56 is provided for each leg 51, and each cylinder 56 is connected between the respective base side membes 11 and 13 and the respective lower leg section 42 by means of suitable connector members 58 secured to the leg sections 42. The secondary cylinder means 56 may be either pneumatic or hydraulic, as desired, and is alternately extendable and contractable, as is well known. Of course, suitable power fluid means (not shown) are connected with each cylinder means 56 for actuation thereof.

In operation, a piece of raw material or the work piece (not shown) which is to be assembled or otherwise manipulated, may be placed on the bed plate 32 and secured thereto by any suitable means (not shown) as hereinbefore set forth. The hydraulic cylinders 34 and 35 may then be actuated for extending the rods 31 and 33, thus forcing the upper frame 22 to move about the axis of the pivot shaft 26. In the full vertical position of the frame 22, one edge 38 thereof comes to rest on the pads 40. During the last portion of the tilting sequence, the secondary cylinder means 56 is activated to an extended position to force the leg brace sections 42 and 48 into substantially axial alignment, as shown in dashed lines in FIGS. 1 and 3. After the selected work operation has taken place, the secondary cylinders 56 may be contracted for "breaking" or initiating the folding of the leg braces 51 simultaneously with the contraction of the hydraulic piston rods 31 and 33 into the cylinders 34 and 35. This brings the upper frame 22 into the horizontal or rest position, as shown in solid lines in FIGS. 1 and 3, whereupon the work piece may be either removed or displaced from the bed plate 32. As can be seen, the present invention provides a tilting work table which is provided with folding leg means which extend into a stiff-leg configuration to rigidly secure the bed plate 32 in the vertical position, or other tilted positions thereof. Further, during certain operations, such as drilling of bores into the work piece, extreme loads are usually placed on the upright bed plate 32 and upper frame 22, thereby placing a load on the cylinders 34 and 35. The folding leg braces take some of this load, along with the cylinders 34 and 35, and in the event of a power failure or loss of fluid at the hydraulic cylinders 34 and 35, the bed plate 32 will be rigidly maintained in the upright or tilted position.

Whereas the present invention has been described in particular relation to the drawings attached hereto, other and further modifications, apart from those shown or suggested herein, may be made within the scope and spirit of this invention.

What is claimed is:

1. A tilting work table for supporting a work piece during a work operation and comprising:

a base means;

a bed plate having a working surface for receiving the work piece thereon, said bed plate being pivotally connected to said base frame;

means operably connected between said base means and said bed plate for moving said bed plate between horizontal and vertical positions;

manually operable folding leg means secured between the base means and bed plate for bracing of the bed plate in the tilted positions thereof to preclude accidental movement of the tilted bed plate toward a horizontal position upon failure of the bed plate moving means;

said folding leg means comprising at least two leg members having the adjacent ends thereof hingedly secured together and movable between alternate extended and collapsed positions; and secondary cylinder means operably connected between the base means and leg means to initiate the collapsing of the leg means.

2. A tilting work table as set forth in claim 1 wherein said secondary cylinder means is pneumatically actuated.

3. A tilting work table as set forth in claim 1 wherein said secondary cylinder means is hydraulically actuated.

* * * * *